US005080356A

United States Patent [19]

Green et al.

[11] Patent Number: 5,080,356

[45] Date of Patent: Jan. 14, 1992

[54] BASE FOR BASEBALL AND SOFTBALL

[76] Inventors: Paul G. Green, 618 N. Central, Apt. 403, Phoenix, Ariz. 85004; Gregory C. Gayne, 4929 W. Hatcher Rd., Glendale, Ariz. 85302

[21] Appl. No.: 654,950

[22] Filed: Feb. 13, 1991

Related U.S. Application Data

[63] Continuation of Ser. No. 352,165, May 15, 1989, abandoned, which is a continuation-in-part of Ser. No. 723,480, Apr. 15, 1985, Pat. No. 4,830,368.

[51] Int. Cl.[5] ..... A63B 71/00

[52] U.S. Cl. ..... 273/25

[58] Field of Search ..... 273/25

[56] References Cited

U.S. PATENT DOCUMENTS

| | | | |
|---|---|---|---|
| 2,138,273 | 11/1938 | Goodrick | 273/25 |
| 2,275,547 | 3/1942 | Mouch | 273/25 |
| 2,624,580 | 1/1953 | Corbett | 373/25 |
| 3,466,039 | 9/1969 | Golomb | 273/25 |
| 3,572,705 | 3/1971 | Wyble | 273/25 |
| 3,743,289 | 7/1973 | Golomb | 273/25 |
| 4,266,768 | 5/1981 | Hall | 273/25 |
| 4,817,946 | 4/1989 | Wilasquez | 273/25 |

*Primary Examiner*—Theatrice Brown
*Attorney, Agent, or Firm*—Charles E. Cates

[57] ABSTRACT

The invention relates to a baseball base which is yieldably attached to a ground support. The base is comprised of a hollow body of resilient material and having a frame therein. A support post of square cross-section is attached to the frame so that the can rotate about the longitudinal axis thereof. A hollow ground anchor of square cross-section is placed in the ground to receive the support post. At least one detent is placed between the frame and ground anchor, a spring is provided to bias the frame towards the ground anchor. The detent acting to hold the base relative to the ground anchor until acted upon by a player sliding into the base, thus causing the base to rotate about the longitudinal axis of the ground anchor.

9 Claims, 10 Drawing Sheets

BASE FOR BASEBALL AND SOFTBALL

FIELD OF THE INVENTION

This application is a continuation of pending application Ser. No. 07/352,165 filed May 15, 1989 (abandoned on filing this application) which is in turn a continuation-in-part of co-pending application Ser. No. 723,480, filed Apr. 15, 1985, now U.S. Pat. No. 4,830,368 issued May 16, 1989.

This invention relates to those bases known as first base, second base, and third base in the sports of baseball and softball.

BACKGROUND OF THE INVENTION

This invention is based on the realization that baseball players and softball players suffer injuries to their feet, ankles, knees, legs, fingers, hands, wrists, elbows, and arms from sliding either incorrectly or too late into rigid, unyielding bases. It is the purpose and function of this invention to provide a more efficiently safe, energy absorbing, energy deflecting, rotatable base that is easily realignable according to the rules of baseball and softball, but which remains stationary and does not come apart on impact. This improvement, by design, conforms to baseball and softball rulebook specifications for bases.

BRIEF DESCRIPTION OF THE INVENTION

The base pad will be cast in one layer of closed cell plastic encompassing the rotating parts of the rotation mechanism (our previous invention comprised four layers of shock absorbent material which had to be assembled and adhered to the rotation mechanism). Also, we have for safety provided tubular voids, to be placed in the intermediate area between the corners of the base pad, whose purpose is to yield and collapse and permit the sliding baserunner to slide up on the base pad.

The components of the rotation mechanism have improvements in the method of manufacture and in the method of assembly. The two main pieces of the rotation mechanism will be injection molded of reinforced plastic, thereby eliminating the shearing, forming and welding of the metal rotation mechanism our previous invention required. The four-leaf clover shape of the paddle arms permits the use of much additional resilient material to protect the sliding base runner and provides greater strength for the paddle arms. An improved biasing method (a quick and easy assembly method) provides downward pressure on the base pad to more securely hold it in place against inadvertent rotation. This improvement also has an improved detent means: mating extended V-shaped projections and extended V-shaped grooves with more surface interfacing. The strength of the detent means can be varied by springs of different compression.

DETAILED SPECIFICATION

Figure 1:
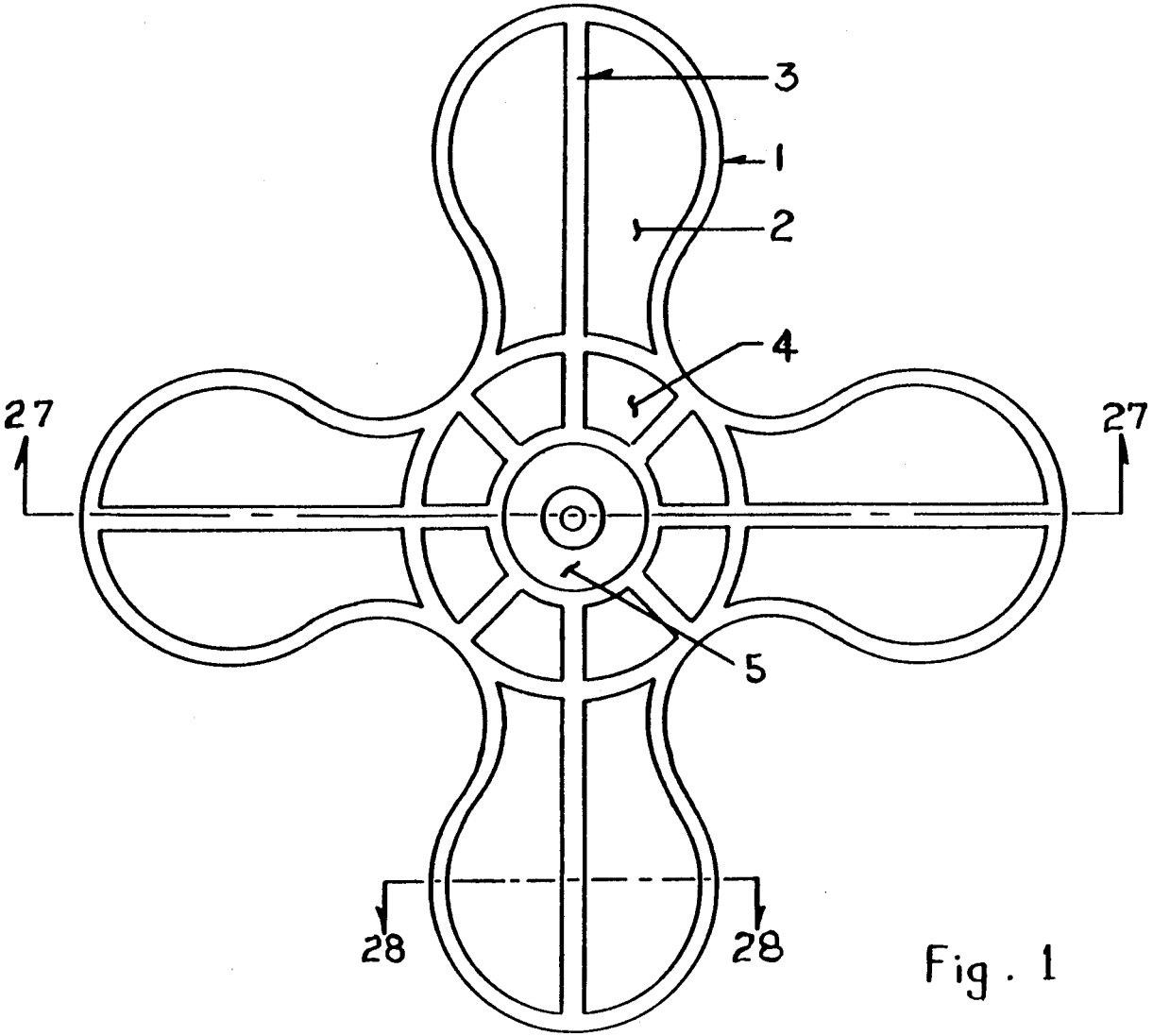
FIG. 1 is a top plan view of the paddle.

An improved base for use on baseball and softball playing fields has a base pad 22 (see FIGS. 9–11) of resilient closed cell foam material 24. Post-disc (post body plus flared section) 26 (also called stake 11) has a hollow body and is adapted to be received in non-rotating relation with a ground receptor (not shown, but well known to the art as a hollow shaft, usually secured in concrete, having a square cross-section suitable for receiving the post disc 26) Cylinder top 4 and paddle arm 1 are adapted to be attached to said base pad 22 and have an extension cone section 5, an extension bushing section 7 and extension spring section 8 which is a member telescoping into said post-disc means 26 in rotatable relation thereto. Biasing means, which here is a spring 18, exerts a downward pressure on said extension sections (5, 7, 8) (see FIG. 8); and cooperating detent means 9, 13 (see FIGS. 7, 8) between cylinder top means and disc means releasably maintain said resilient base pad 22 in a selected, rotated position.

The base pad contains molded tubular voids 20 in a cast layer of resilient material extending upwardly and toward the periphery of the base pad 22 to allow the base pad to yield laterally and downwardly when engaged by a player sliding into the base.

The post disc 26 (FIG. 11), cylinder top 4 (FIG. 3) and paddle arms 1 (FIG. 1), and extension sections 5, 7, 8, are parts of the improved rotation mechanism and are formed of reinforced plastic.

The post-disc 26 provides an extension spring stop 15 (FIGS. 7, 8) which the biasing means (preferably spring 18) engages. Removable means (roll pin 19) (FIG. 8) retains said biasing means.

Figure 2:
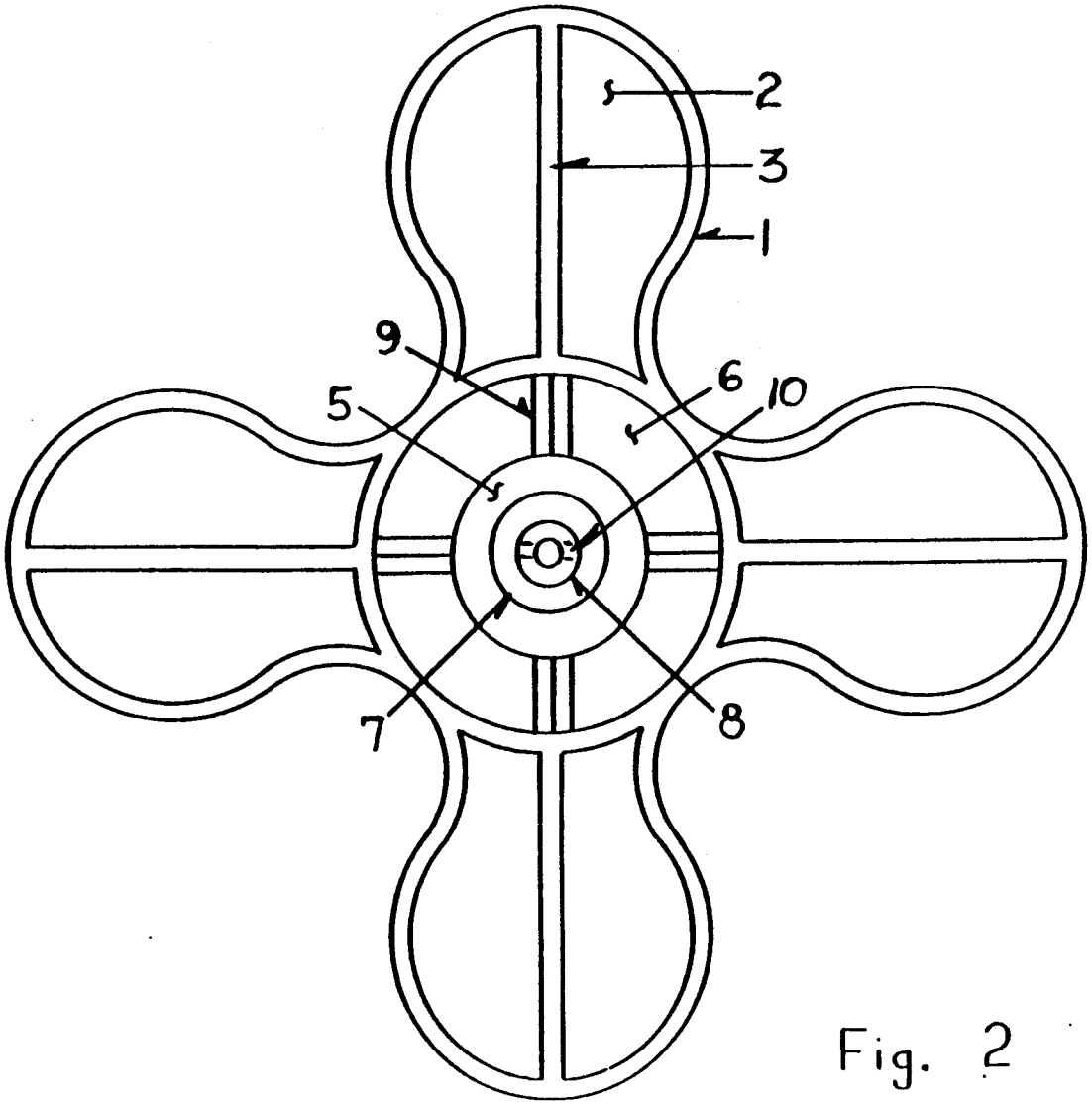
FIG. 2 is a bottom plan view of the paddle of FIG. 1.
Figure 5:
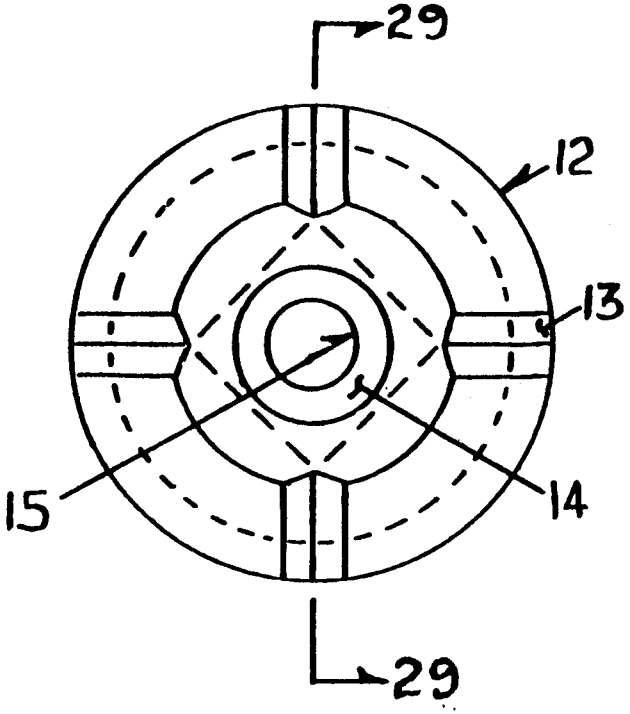
FIG. 5 is a top plan view of the post disc.

The post disc 26 and cylinder top 4 provide detent means comprising V-shaped grooves 13 (FIGS. 5, 7) in either disc or cylinder top, and mating V-shaped projections 9 (FIG. 2) in the other of said means adapted to be received in said grooves to provide detent means acting in either direction of rotation of said base.

An improved base has a resilient base pad 22 of generally rectangular form, cylinder top 4 and paddle arm 1 means attached to the pad 22 and indented intermediately of the corners of said pad which provide increased yielding space intermediate to the corners of said base pad.

The cylinder top 4 and paddle arm means 1 make a frame attached to the base pad 22 in substantially a four-leaf clover shape, the leaves being aligned with the corners of said base pad.

The base pad 22 includes molded tubular voids 20 located intermediately of the corners of said base pad, said molded tubular voids 20 being aligned upwardly and toward the periphery of said base pad.

The paddle arm portion of the mechanism has four paddle arms 1 encompassing the paddle arm surface 2.

Also shown is the reinforcement rib structure 3 which surrounds the paddle arms 1, the cylinder top 4, and the extension cone 5.

Figure 3:
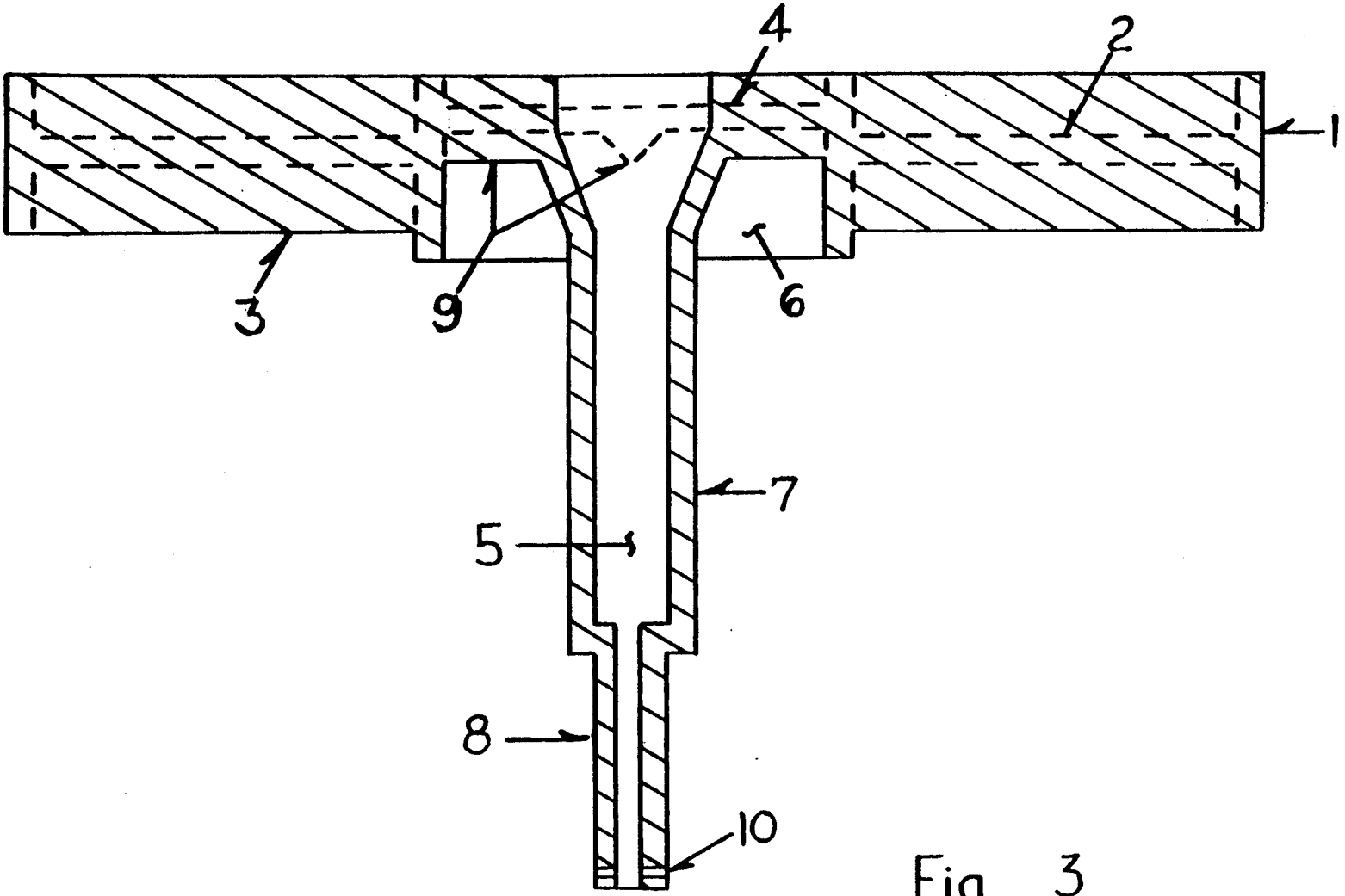
FIG. 3 is a cross sectional view of the paddle taken along the line 27—27.
Figure 4:
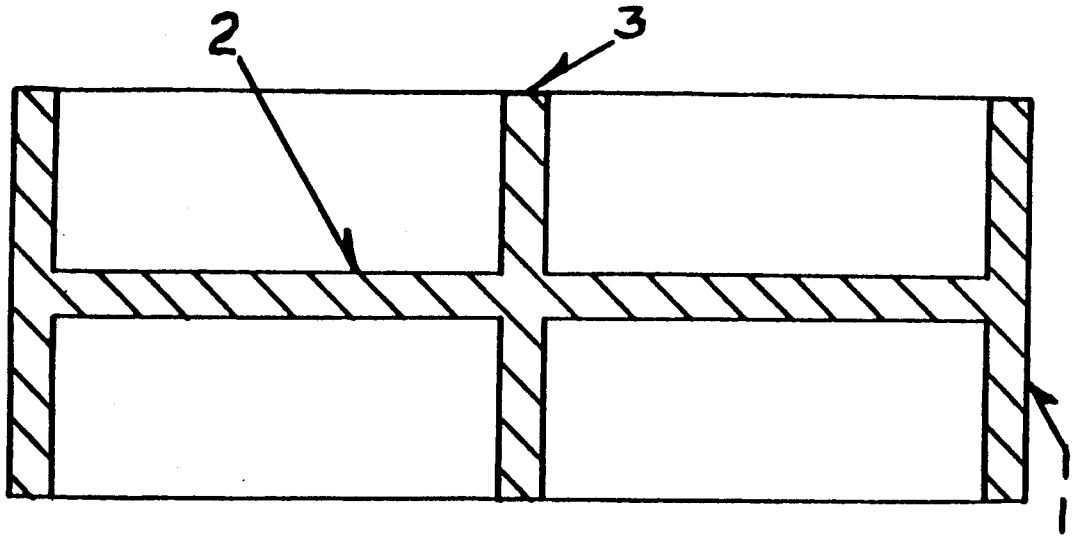
FIG. 4 is a cross sectional view of the paddle arm taken along the line 28—28.
Figure 6:
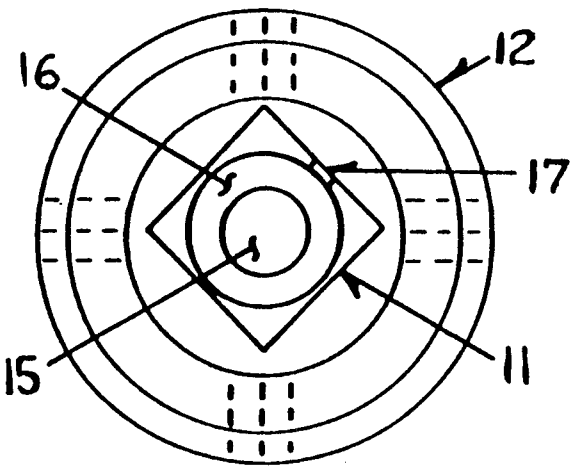
FIG. 6 is a bottom plan view of the post disc of FIG. 5.
Figure 11:
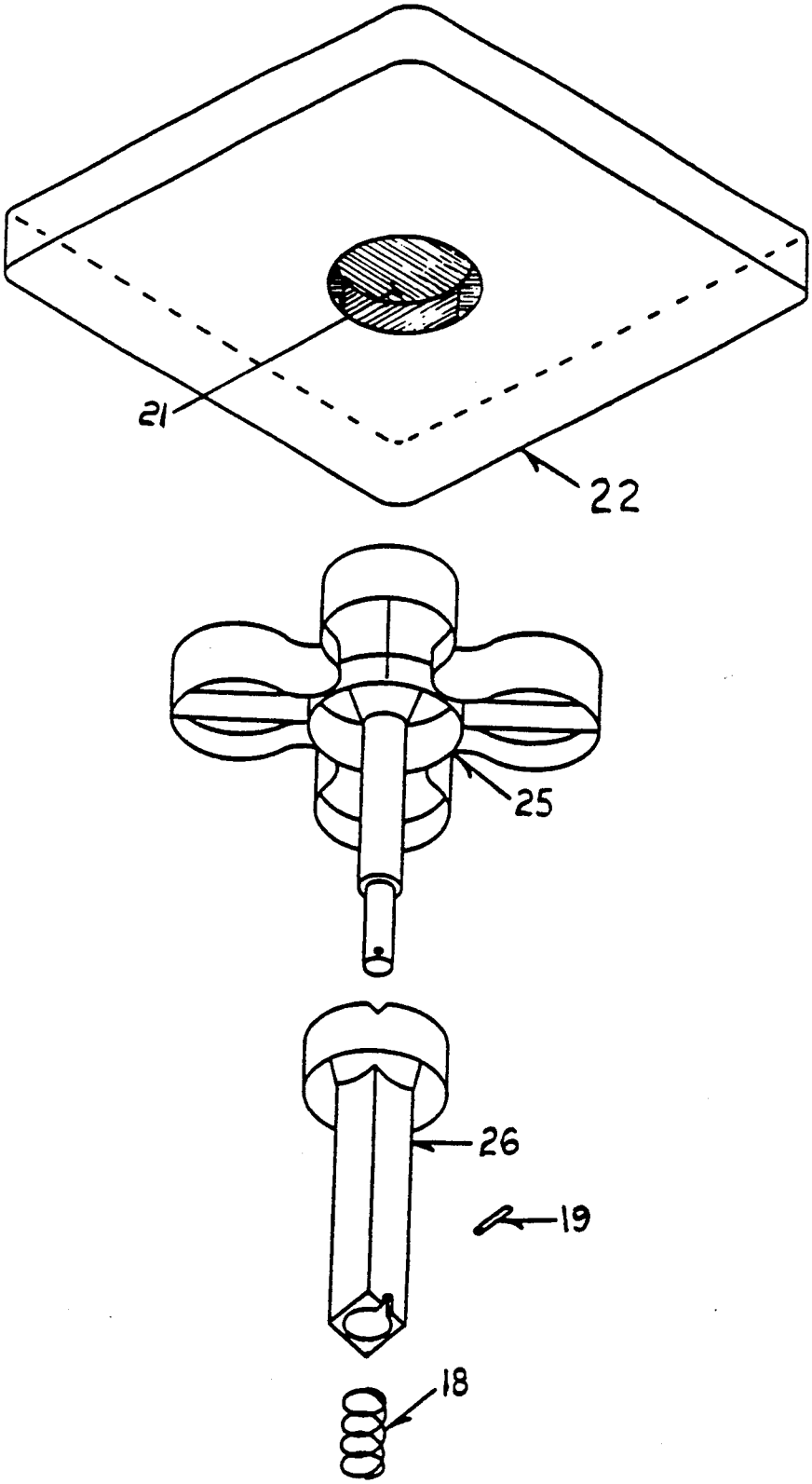
FIG. 11 is an exploded schematic view of the five component parts (22, 25, 26, 18 and 19) of the base assembly.

In FIG. 3, which is a section view of the paddle 25 and extension bushing section 7 portion of the mechanism of FIG. 11, the paddle arms 1 show the full width of the reinforcement rib structure 3 and the placement of the paddle arm lower surface. Also shown (see FIGS. 3, 7) are the cylinder 12, the cylinder cavity 6, projections 9, cavities 13, and the extension bushing section 7 and the extension spring section 8 showing the location of the roll pin hole 10. There is an extension cavity which passes totally through the post-disc 26.

In through the stake 11 (FIG. 7) are the extension bushing cavity 14, the extension spring stop section 15, and the spring cavity 16. Also passing perpendicular through a side of the stake 11 is the roll pin access slot 17.

Figure 9:
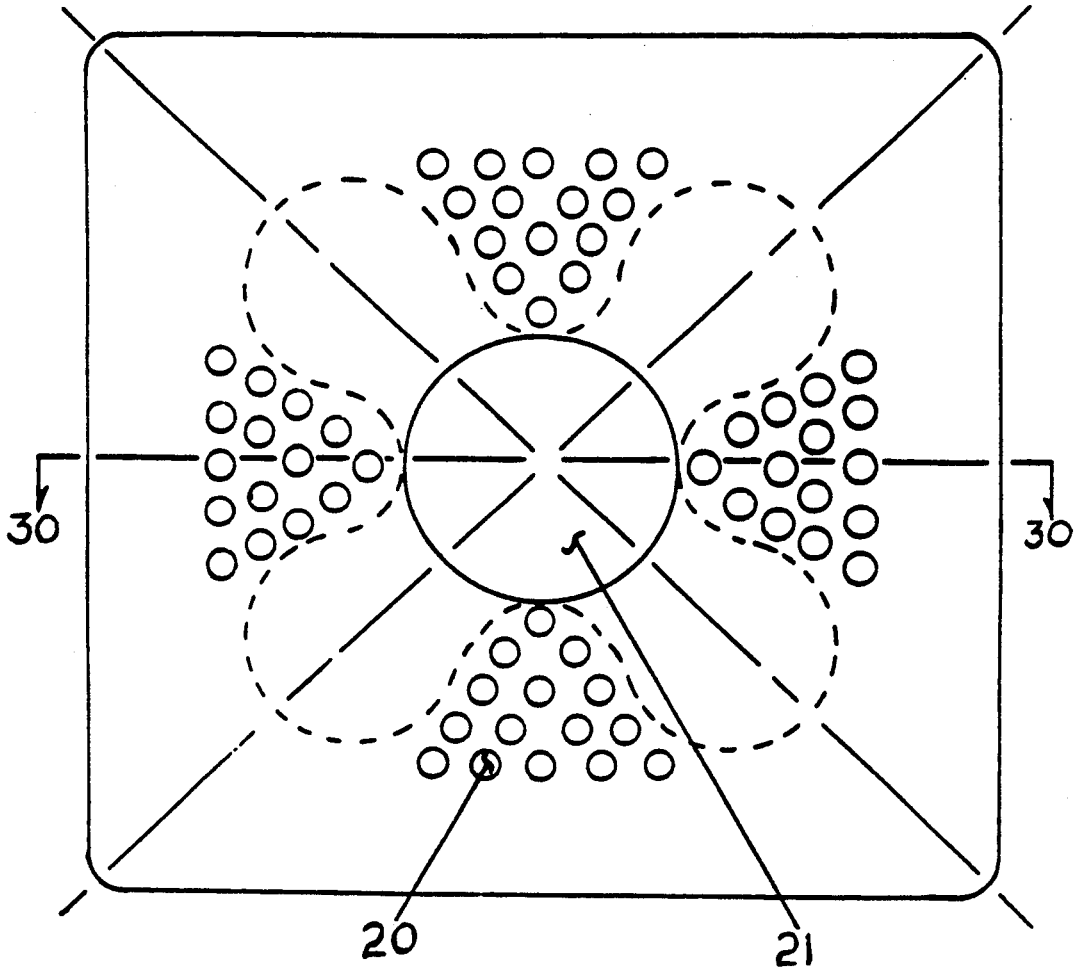
FIG. 9 is a bottom plan view of the base pad.

FIG. 9 is a bottom view of the base pad 22. Typical are the tubular voids 20 passing into but not through the body of the base pad 22, as does the paddle cavity 21.

Figure 10:
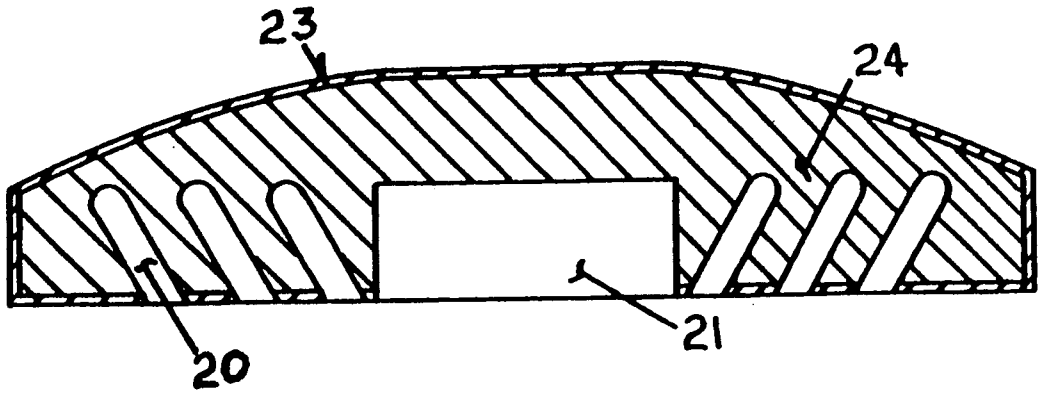
FIG. 10 is a cross sectional view of the base pad of FIG. 9 taken along the line 30—30.

FIG. 10 shows the suggested direction of the molded tubular voids 20 and the paddle cavity 21.

Figure 7:
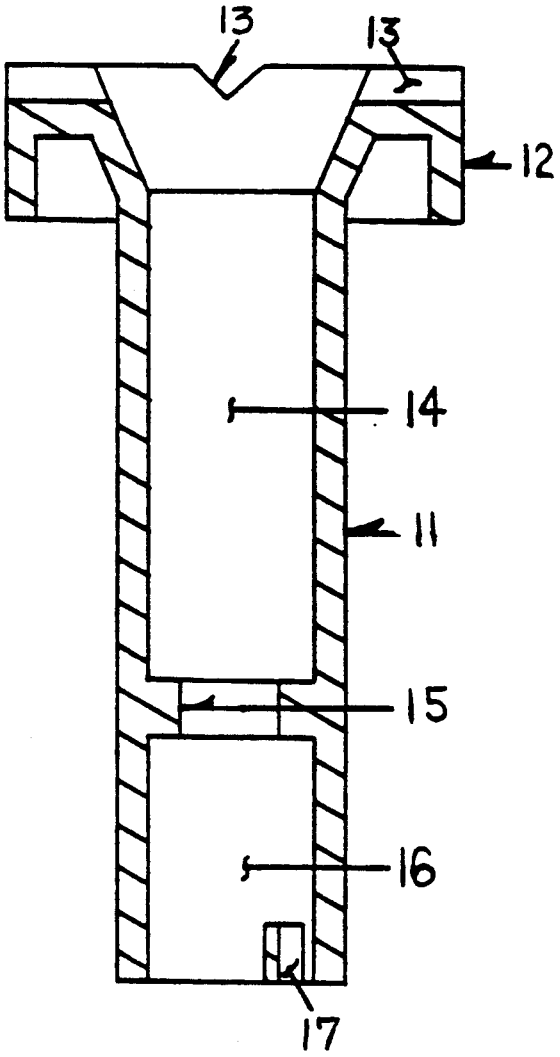
FIG. 7 is a cross sectional view of the post disc of FIG. 5 taken along the line 29—29.
Figure 8:
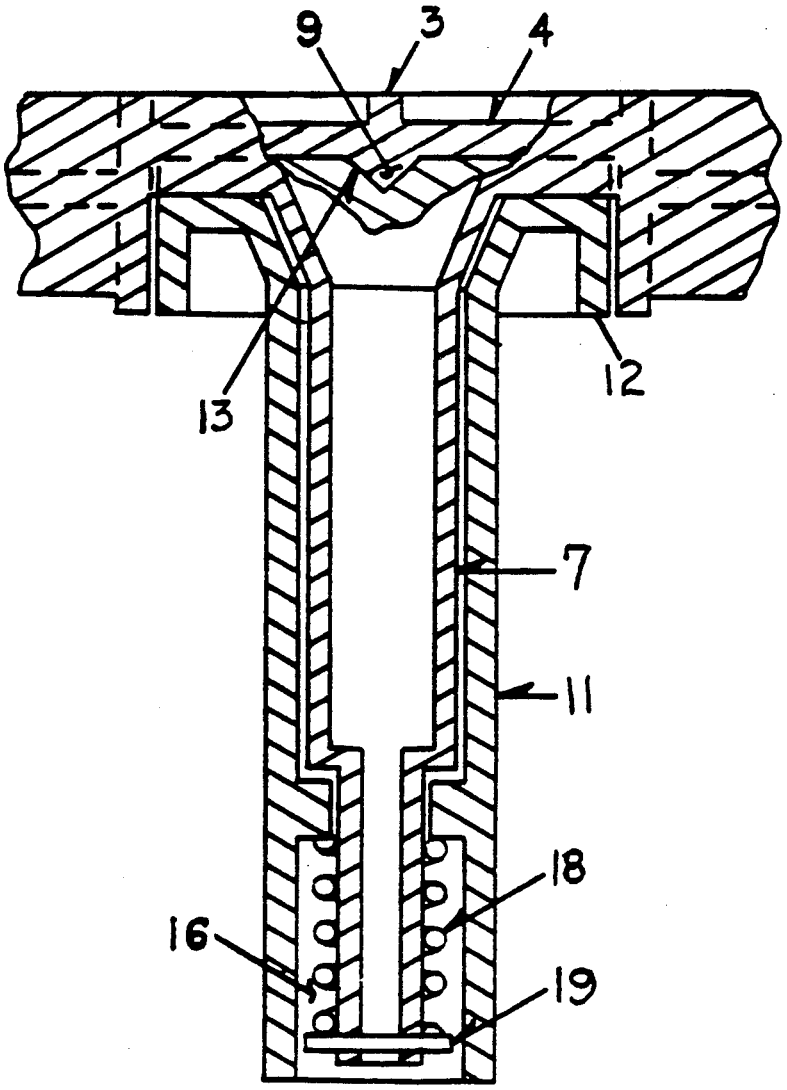
FIG. 8 is a cross sectional view depicting an assembled paddle and post disc.

In FIG. 11 the base pad 22 encompasses the paddle 25 which fits into the stake 11 and is held in place by the spring 18 which is compressed and secured in position by the roll pin 19 and extension spring stop 15 (not shown this view, but see FIG. 7).

INDEX OF TERMS OF THE DRAWINGS

1. Paddle Arm
2. Paddle Arm Surface
3. Reinforcement Rib Structure
4. Cylinder Top
5. Extension Cone
6. Cylinder Cavity
7. Extension Bushing Section
8. Extension Spring Section
9. Projections
10. Roll Pin Hole
11. Stake
12. Cylinder
13. Projection Cavity
14. Extension Bushing Cavity
15. Extension Spring Stop
16. Spring Cavity
17. Roll Pin Access Slot
18. Spring
19. Roll Pin
20. Tubular Void
21. Base Pad Paddle Cavity
22. Base Pad
23. Epidermal Layer
24. Closed Cell Foam
25. Paddle
26. Post Disc

What we claim is:

1. A baseball and softball base apparatus comprising:
   a. a base pad comprising a resilient material;
   b. post means for anchoring in the ground;
   c. attachment means for attaching said base pad to said post means and permitting the rotation of said base pad about the longitudinal axis of said post means, and
   d. detent means comprising means for locating and yieldably detaining said base pad relative said post means; said base pad being rotatable about the longitudinal axis of said post means when said base pad is contacted by a player sliding thereinto.

2. The apparatus of claim 1 wherein:
   a. said post means comprises a hollow body;
   b. said attachment means further comprises:
      a frame attached to said base pad and having a member extending downwardly into said hollow body; and
   c. said locating and detaining means further comprises:
      (1) mating tongue and groove means carried by said frame and said post means; and
      (2) means for yieldably biasing said tongue and groove means together; whereby said tongue means may be moved out of said groove means by pressure against said base pad.

3. The apparatus of claim 2 wherein said means for yieldably biasing said tongue and groove means together is a spring operatively connected to said frame and said post.

4. The apparatus of claim 2 wherein said base pad is a resilient material formed about said frame and the remainder of said apparatus is reinforced plastic.

5. The apparatus of claim 2 wherein said frame has a four-leaf clover shape with the leaves aligned with the corners of said base pad.

6. The apparatus of claim 5 wherein said base pad includes tubular voids located in said resilient material between the leaves of said four-leaf clover.

7. The apparatus of claim 2 further comprising a receptacle in the ground for receiving and anchoring said post means.

8. The base apparatus of claim 1 wherein said resilient material comprises a cast layer of foam plastic.

9. The base apparatus of claim 1 wherein said base pad further comprises tubular voids in said resilient material extending upwardly and toward the periphery of said base pad.

* * * * *